US008872702B2

(12) United States Patent
Roy

(10) Patent No.: US 8,872,702 B2
(45) Date of Patent: Oct. 28, 2014

(54) TUNEABLE PCB ANTENNA

(75) Inventor: Iain Campbell Roy, Irvine (CA)

(73) Assignee: Psion Inc., Mississauga, Ontario (CA)

( * ) Notice: Subject to any disclaimer, the term of this patent is extended or adjusted under 35 U.S.C. 154(b) by 449 days.

(21) Appl. No.: 12/765,917

(22) Filed: Apr. 23, 2010

(65) Prior Publication Data

US 2011/0260924 A1 Oct. 27, 2011

(51) Int. Cl.
*H01Q 1/38* (2006.01)

(52) U.S. Cl.
USPC ..... 343/700 MS

(58) Field of Classification Search
USPC ..... 343/700 MS, 702, 789, 784, 772, 780
See application file for complete search history.

(56) References Cited

U.S. PATENT DOCUMENTS

| | | | | |
|---|---|---|---|---|
| 4,086,598 | A * | 4/1978 | Bogner | 343/768 |
| 5,936,590 | A * | 8/1999 | Funder | 343/795 |
| 6,680,712 | B2 * | 1/2004 | Yamamoto et al. | 343/789 |
| 7,053,848 | B2 * | 5/2006 | Shoji et al. | 343/770 |
| 7,406,344 | B2 | 7/2008 | Fifield | |
| 2004/0239575 | A1 * | 12/2004 | Shoji et al. | 343/770 |
| 2011/0227795 | A1 * | 9/2011 | Lopez et al. | 343/700 MS |

OTHER PUBLICATIONS

International Preliminary Report on Patentability and Written Opinion for counterpart International Patent Application No. PCT/CA2011/000364 mailed on Nov. 1, 2012.
Corresponding PCT International Application No. PCT/CA2011/000364 Search Report dated Aug. 3, 2011.
Corresponding PCT International Application No. PCT/CA2011/000364 Written Opinion of the International Searching Authority dated Aug. 3, 2011.

* cited by examiner

*Primary Examiner* — Huedung Mancuso

(57) ABSTRACT

An antenna and antenna manufacturing process for an antenna configured for at least one of transmission or reception of electromagnetic waves with respect to a surrounding environment, the antenna having an antenna element positioned in metal trace on a carrier body, antenna element being isolated from an electrical ground of the antenna. The antenna comprises: at least one predefined removal portion positioned in the carrier body for containing a removal fraction of the antenna element, such that the carrier body located outside of the predefined removal portion is configured to contain the remainder fraction of the antenna element; and a weakness pattern in the carrier body about at least part of the periphery of the at least one predefined removal portion, the weakness pattern configured for predisposing the carrier body to break along the weakness pattern upon application of force, such that the at least one predefined removal portion and corresponding removal fraction would be separated from the antenna upon application; wherein the separation of the predefined removal portion and corresponding removal fraction provides for modification of at least one tuning parameter of the antenna having the remainder fraction as the tuned antenna element.

20 Claims, 17 Drawing Sheets

TUNEABLE PCB ANTENNA

The present invention relates to PCB antennas and their construction.

BACKGROUND

A portable electronic communication device, such as a personal digital assistant (PDA), a mobile phone, or a smart phone, requires an antenna to establish a wireless connection with another device in the communication system. Mobile communication providers provide mobile communication services using a predetermined frequency band allocated thereto. Accordingly, mobile terminal manufacturers provide different antennas for the different frequency bands provided by the mobile communication providers. Therefore, in order for a mobile terminal that provides a communication service in a high frequency band to also provide a communication service in a low frequency band, the mobile terminal requires an additional mounting space for additional antenna length to also handle the low frequency band, and thus a change in the design of the mobile terminal is necessary. This increases costs to a mobile terminal manufacturer due to design changes and redevelopment of the antenna and also results in a corresponding increase in purchase price of the mobile terminal for a consumer.

The performance of an antenna will impact the communication range of a RF system. Since range is often a critical factor when designing RF systems, it is important to be able to characterize the antenna. One parameter that is important, and which can easily be measured is the return loss (RL). Impedance mismatch between the feeding transmission line and the antenna causes reflection at the feed point of the antenna. Because of this reflection not all of the available power will reach the antenna, and thus the field strength of the radiated signal will be reduced. RL describes how much of the available power is reflected at the feed point of the antenna.

PCB (printed circuit board) antennas are one example of antennas that are sensitive to surroundings, including such sensitivity factors as PCB material, layout of antenna element and/or ground plane element, other nearby electrical components, nearby metal materials, device housings forming antenna enclosures and so on. For example, two PCB antennas with the same size patterned as traces on different PCBs may demonstrate different performances. Even two identical PCB antennas may have two distinct resonant frequency values and input impedance values when used in different products. If the resonant frequency shifts out of band, the input impedance increases/decreases beyond tolerance or other performances beyond tolerance, the designer will encounter a big problem in designing and verifying procedures of the antenna.

When a PCB antenna designed for a specific product is tested and found that its resonant frequency is out of band, input impedance is beyond tolerance or other performances are beyond tolerance, the layout of the PCB antenna typically is redesigned to form a modified PCB antenna accordingly. The design and test procedures will be continuously performed until the modified PCB antenna passes the verification test. Besides, if the housing or the PCB material of the product is changed by manufacturers due to some reasons, it typically needs a PCB antenna of new version to fit the change of the surroundings, which is time consuming and cost effective. The condition becomes worse when a particular portable electronic communication device requires different antennas for different applications, e.g. cellular, GPS, Bluetooth and so on, some of which operate at different bands (i.e. differently configured antennas) depending upon the country of operation.

For a designer, adding a matching circuit to a feed pin of the PCB antenna without adjusting the layout of the PCB antenna is another practicable manner. However, there are only several specific matching circuits available in the markets and the properties of matching circuits are different based on different suppliers, such that the performances of the PCB antennas having different matching circuits are discrete. That is, the PCB antenna resonates at M frequency when a M matching circuit is added to the PCB antenna, and the PCB antenna resonates at N frequency when a N matching circuit is added to the PCB antenna. And the designer cannot make the PCB antenna operate at an arbitrarily frequency between M and N because a suitable matching circuit is unavailable.

There are several ways to tune an antenna to achieve better performance. For resonant antennas the main factor is the length. Ideally the frequency which gives least reflection should be in the middle of the frequency band of interest. Thus if the resonance frequency is too low, the antenna should be made shorter. If the resonance frequency is too high, the antenna length should be increased. Even if the antenna resonates at the correct frequency it might not be well matched to the correct impedance. Dependent of the antenna type there are several possibilities to obtain optimum impedance at the correct frequency. Size of ground plane, distance from antenna to ground plane, dimensions of antenna elements, feed point, and plastic casing are factors that can affect the impedance. Thus by varying these factors it might be possible to improve the impedance match of the antenna. However, all of these methods are time consuming in the design process.

Thus, there is a need for a method for adjusts the resonant frequency, the input impedance and/or other performances of a PCB antenna effectively and economically, and a structure thereof.

SUMMARY

There is a need for an improved antenna that overcomes or otherwise mitigates at least one of the above discussed disadvantages.

There are several ways to tune an antenna to achieve better performance. For resonant antennas the main factor is the length. Even if the antenna resonates at the correct frequency it might not be well matched to the correct impedance. Dependent of the antenna type there are several possibilities to obtain optimum impedance at the correct frequency. However, all of these methods are time consuming in the design process. Contrary to current antenna designs there is provided an antenna and antenna manufacturing process for an antenna configured for at least one of transmission or reception of electromagnetic waves with respect to a surrounding environment, the antenna having an antenna element positioned in metal trace on a carrier body, antenna element being isolated from an electrical ground of the antenna. The antenna comprises: at least one predefined removal portion positioned in the carrier body for containing a removal fraction of the antenna element, such that the carrier body located outside of the predefined removal portion is configured to contain the remainder fraction of the antenna element; and a weakness pattern in the carrier body about at least part of the periphery of the at least one predefined removal portion, the weakness pattern configured for predisposing the carrier body to break along the weakness pattern upon application of force, such that the at least one predefined removal portion and corresponding removal fraction would be separated from the antenna upon application; wherein the separation of the predefined removal portion and corresponding removal fraction provides for modification of at least one tuning parameter of the antenna having the remainder fraction as the tuned antenna element.

A first aspect provided is An antenna configured for at least one of transmission or reception of electromagnetic waves with respect to a surrounding environment, the antenna having an antenna element positioned in metal trace on a carrier body, antenna element being isolated from an electrical ground of the antenna, the antenna comprising: at least one predefined removal portion positioned in the carrier body for containing a removal fraction of the antenna element, such that the carrier body located outside of the predefined removal portion is configured to contain the remainder fraction of the antenna element; and a weakness pattern in the carrier body about at least part of the periphery of the at least one predefined removal portion, the weakness pattern configured for predisposing the carrier body to break along the weakness pattern upon application of force, such that the at least one predefined removal portion and corresponding removal fraction would be separated from the antenna upon application; wherein the separation of the predefined removal portion and corresponding removal fraction provides for modification of at least one tuning parameter of the antenna having the remainder fraction as the tuned antenna element.

a second aspect provided is a method for manufacturing an antenna configured for at least one of transmission or reception of electromagnetic waves with respect to a surrounding environment, the antenna having an antenna element positioned in metal trace on a carrier body, antenna element being isolated from an electrical ground of the antenna, the method comprising the steps of: providing a carrier body; forming a weakness pattern in the carrier body about at least part of the periphery of at least one predefined removal portion, the weakness pattern configured for predisposing the carrier body to break along the weakness pattern upon application of force, the at least one predefined removal portion positioned in the carrier body for containing a removal fraction of the antenna element, such that the carrier body located outside of the predefined removal portion is configured for containing the remainder fraction of the antenna element; and applying the metal trace of the antenna element on the carrier body to form the removal fraction and the remainder fraction; wherein application of the force and subsequent separation of the predefined removal portion and corresponding removal fraction from the carrier body provides for modification of at least one tuning parameter of the antenna having the remainder fraction as the tuned antenna element.

BRIEF DESCRIPTION OF THE DRAWINGS

These and other features of the invention will become more apparent in the following detailed description in which reference is made to the appended drawings by way of example only, wherein.

DESCRIPTION

Figure 1:
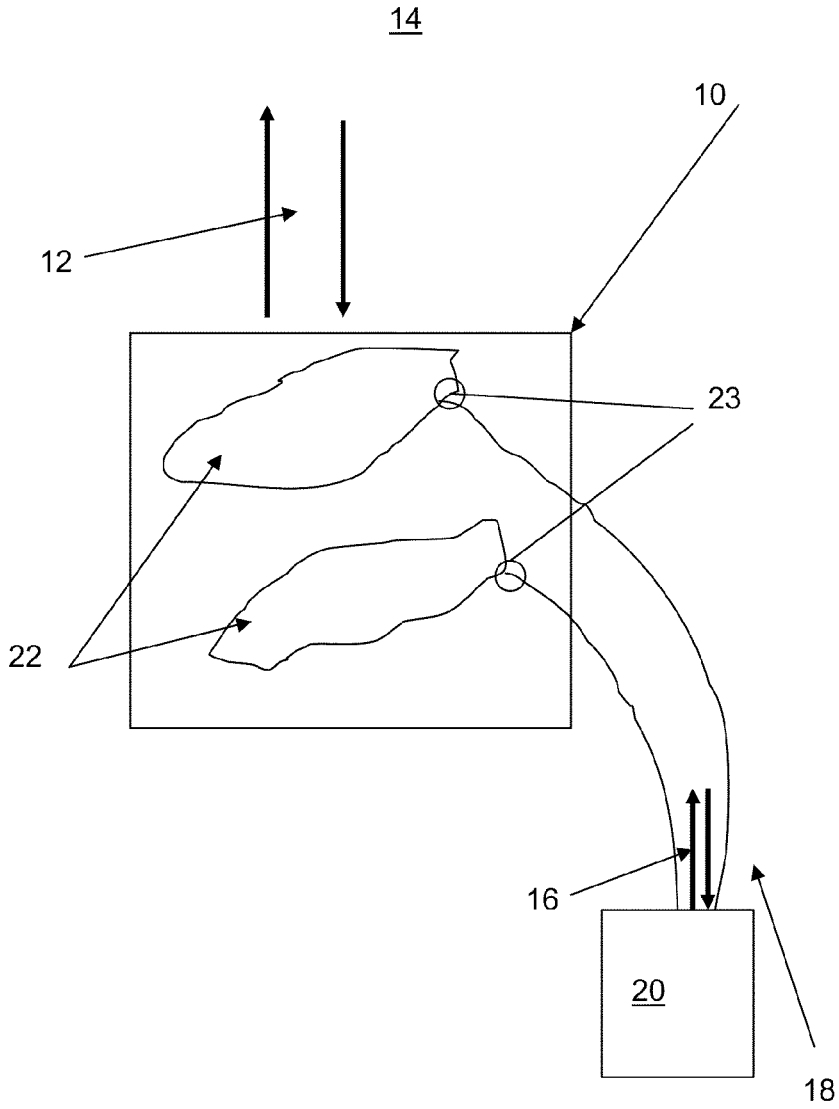
FIG. 1 is a diagram of an antenna with environment.

The present invention relates generally to a tuneable PCB antenna 10 (see FIG. 2) for a mobile terminal 20, and more particularly, to an antenna 10 including one or more removable portions 32 of a PCB substrate 24 supporting an antenna pattern 22, in order to shift a first resonance frequency of the antenna pattern 22 to a second resonance frequency. Further, the removable portions 32 can be used to otherwise tune the antenna 10 for a selected resonance frequency to facilitate improved PCB antenna 10 performance when matched/associated to a particularly configured portable device 20, as further described below.

Device 20

Figure 4:
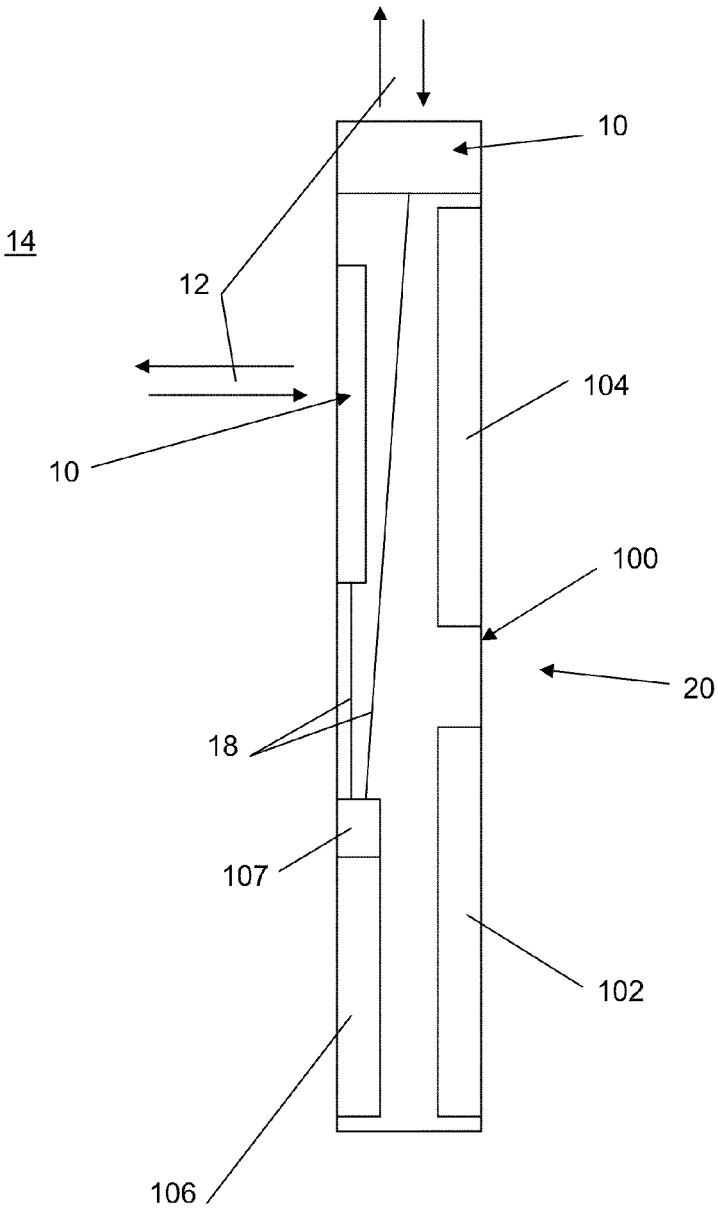
FIG. 4 is an embodiment of the antenna of FIG. 1 in a handheld device.

Referring to FIG. 4, the handheld terminal 20 can have the PCB antenna 10 coupled via a feed line 18 to a battery 106 and a transceiver 107 (for example as a transmitter only for transmitting, a receiver only for receiving or combined as the transceiver for both transmission and reception of the waves 12) and housed at lease partially in a main housing 100 of the handheld 20 (e.g. on the backside of the housing opposite a display 104 and/or a keyboard 102). Another configuration example is on the end of the handheld 20 adjacent to the display 104 and/or the keypad 102. It is recognised that the PCB antenna 10 can be configured to operate as a communication antenna for WAN, WIFI, Bluetooth, GPS or as an RFID antenna. It is also recognized that the handheld 20 can be embodied as a generic mobile device such as a mobile communication device, the handheld as described, or a body-worn personal communication device.

Antenna 10

Referring to FIG. 1, a PCB antenna 10 is a transducer designed to transmit and/or receive electromagnetic waves 12 from a surrounding environment 14. Accordingly, PCB antennas 10 convert electromagnetic waves 12 into electrical currents 16 (e.g. receive operation) and convert electrical currents 16 into electromagnetic waves 12 (e.g. transmit operation), such that the electrical current 16 is communicated via a transmission line/cable/lead 18 coupled between the PCB antenna 10 and a current source/sink 20 (e.g. a transmitter, a receiver, a transceiver of a portable device).

PCB antennas 10 can be used in systems such as point-to-point radio communication, wireless LAN, radar, product tracking and/or monitoring via Radio-frequency identification (RFID) applications, and space exploration. It is recognised that the PCB antenna 10 can be incorporated into or otherwise coupled to a computing device such as portable handheld device 20 (see FIG. 4) acting as the current source/sink 20.

Radio frequency (RF) radiation 12 is a subset of electromagnetic radiation 12 with a wavelength of 100 km to 1 mm, which is a frequency of 300 Hz to 3000 GHz, respectively. This range of electromagnetic radiation 12 constitutes the radio spectrum and corresponds to the frequency of alternating current electrical signals 16 used to produce and detect radio waves 12 in the environment 14. Ultra high frequency (UHF) designates a range of electromagnetic waves 12 with frequencies between 300 MHz and 3 GHz (3,000 MHz), also known as the decimeter band or decimeter wave as the wavelengths range from one to ten decimeters (10 cm to 1 meter). For example, RF can refer to electromagnetic oscillations in either electrical circuits or radiation through air and space. Like other subsets of electromagnetic radiation, RF travels at the speed of light. It is also recognised that the radio waves 12 can be detected and/or generated by the antenna 10 in frequency ranges other than in the UHF band, such as but not limited to a plurality of frequency sub-bands (e.g. dual/multi-band 3G/4G applications such as UMTS or CDMA or WiMAX or WiFi in which there are multiple so-called frequency bands—for example 700/850/900 MHz and 1800/1900/2100 MHz within two major low and high wavelength super bands). Accordingly, it is recognised that the antenna 10 described herein is not limited to UHF RFID applications and could readily be applied to any radio communication technology at UHF frequencies or higher frequencies (e.g. WAN, WIFI, Bluetooth, GPS and/or other).

Physically, the PCB antenna 10 is an arrangement of one or more conductors 22, usually called elements 22 in this context positioned on a carrier/substrate 24 used to electrically isolate the antenna element 22*a* from the ground element 22*b*. In transmission, the alternating current 16 is created in the elements 22 by applying a voltage at the antenna terminals 23, causing the elements 22 to radiate the electromagnetic field 12. In reception, the inverse occurs such that the electromagnetic field 12 from another source induces the alternating current 16 in the elements 22 and a corresponding voltage at the antenna's terminals 23. Some receiving PCB antennas 10 (such as parabolic and horn types) incorporate shaped reflective surfaces to collect EM waves 12 from free space and direct or focus them onto the actual conductive elements 22.

There are two fundamental types of PCB antenna 10 directional patterns, which, with reference to a specific two dimensional plane (usually horizontal [parallel to the ground] or vertical [perpendicular to the ground]), are either: omni-directional (radiates equally in all directions), such as a vertical rod (in the horizontal plane); or directional (radiates more in one direction than in the other). For example, omni-directional can refer to all horizontal directions with reception above and below the PCB antenna 10 being reduced in favour of better reception (and thus range) near the horizon. A directional PCB antenna 10 can refer to one focusing a narrow beam in a specified specific direction or directions. By adding additional elements (such as rods, loops or plates) and arranging their length, spacing, and orientation, a PCB antenna 10 with desired directional properties can be created. A PCB antenna 10 array can be defined as two or more simple antennas 10 positioned on the carrier 24 combined to produce a specific directional radiation 12 pattern, such that the array is composed of active elements 22. PCB antenna 10 arrays may be built up from any basic antenna 10 type, such as dipoles, loops or slots, further provided by example below.

The gain as a PCB antenna 10 parameter measures the efficiency of a given antenna 10 with respect to a given norm, usually achieved by modification of its directionality. A PCB antenna 10 with a low gain emits radiation 12 with about the same power in all directions, whereas a high-gain PCB antenna 10 will preferentially radiate 12 in particular directions. Specifically, the gain, directive gain or power gain of the PCB antenna 10 can be defined as the ratio of the intensity (power per unit surface) radiated 12 by the PCB antenna 10 in a given direction at an arbitrary distance divided by the intensity radiated 12 at the same distance by a hypothetical isotropic PCB antenna 10.

In any event, it is recognised that the PCB antenna 10 can comprise: an antenna element 22*a* configured to be isolated from an electrical ground 22*b* of the PCB antenna 10; a transmission line 18 having a pair of electrical conductors such that a first conductor of the pair of electrical conductors is connected to the antenna element 22*a* and a second conductor of the pair of electrical conductors is configured for coupling to the electrical ground 22*b*; and a carrier/substrate 24 having a selected relative static permittivity, such that the substrate 24 is positioned between the antenna element 22*a* and the electrical ground 22*b* and the antenna element 22*a* is attached to a first surface of the substrate 24.

Figure 2:
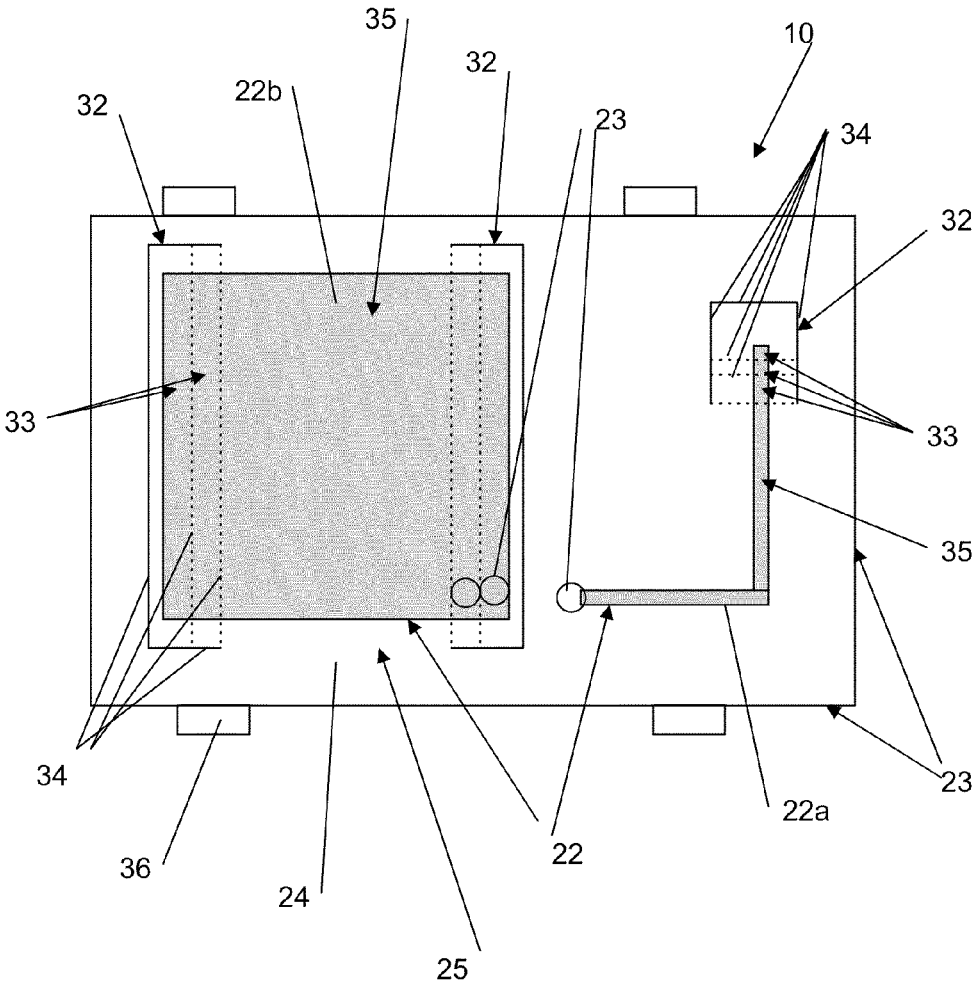
FIG. 2 and FIG. 3 are various embodiments of the antenna of FIG. 1.

In telecommunication, there are several types of microstrip PCB antennas 10 (also known as printed antennas), the most common of which is the microstrip patch PCB antenna 10 or patch PCB antenna 10 type. Referring to FIG. 2, the microstrip PCB antenna 10 of the present embodiments is a PCB antenna 10 (e.g. narrowband, wide-beam) fabricated by etching or otherwise positioning an antenna element 22 (i.e. antenna element 22*a*) pattern in metal trace (e.g. a plurality of metallic lines such as a fractal pattern and/or other geometrical shapes such as a circle, square, rectangle, ellipse, or other solid/continuous shapes) bonded (e.g. via adhesive) to a composite substrate 24 with dielectric properties, with an optional metal layer (e.g. continuous) bonded to the opposite side of the composite substrate 24 used as an antenna grounding structure 22*b* (for establishing a reference potential level for operating the active antenna 10). The antenna grounding structure 22*b* can be any structure closely associated with (or acting as) the ground which is connected to the terminal of the signal receiver or source 20 (see FIG. 1) opposing the active antenna terminals 23. It is recognised in FIG. 2 that the illustrated shapes of the elements 22*a*,22*b* are by example only, and as such the metallic elements 22*a,b* can take the form of shapes such as but not limited to planar or non-planar shapes (e.g. square, circular, rectangular, ellipse, etc.) and/or multiple traces (e.g. lines of selected width) configured into a selected pattern (e.g. fractal, dipole, loop, slot, etc.). For example, microstrip PCB antennas 10 can be usually employed at UHF and higher frequencies since the size of the antenna element 22*a* can influence the wavelength at the resonance frequency of the PCB antenna 10.

Antenna Element 22*a*

The antenna element 22*a* operates as radiating surface for impinging electromagnetic radiation 12 coming from or going to the active antenna 10. For example, the antenna element 22*a* is not connected to the ground 26, as compared to the provided configuration of ground element 22*b*. Instead, the antenna element 22*a* is electrically insulated from the ground 26. It is recognised that one or more linear slots and/or grooves in the exterior surface (facing the environment 14) of the antenna element 22*a* can be used for tuning of the antenna 10 to desired frequency bands and/or for desired polarization diversities. It is also recognised that these linear slots and/or grooves can also be used to account for non-equal side dimensions of the element 22*a* (e.g. rectangular and therefore no square), thus making the rectangular shaped antenna element 22*a* appear to the antenna 10 as square shaped and thus compatible with circular polarized diversity tuning for the antenna 10. It is recognised that the length and/or width of the antenna element 22*a* trace on the carrier 24 can influence the gain, resonant frequency/frequency band, and/or the impedance of the PCB antenna 10.

The antenna element 22*a* can be formed on the carrier body 24 as conductive (e.g. metallic) pathways, patches, tracks, and/or trace patterns, for example etched from copper sheets laminated onto a non-conductive substrate (e.g. carrier body 24).

Grounding Structure Element 22*b*

Figure 3:
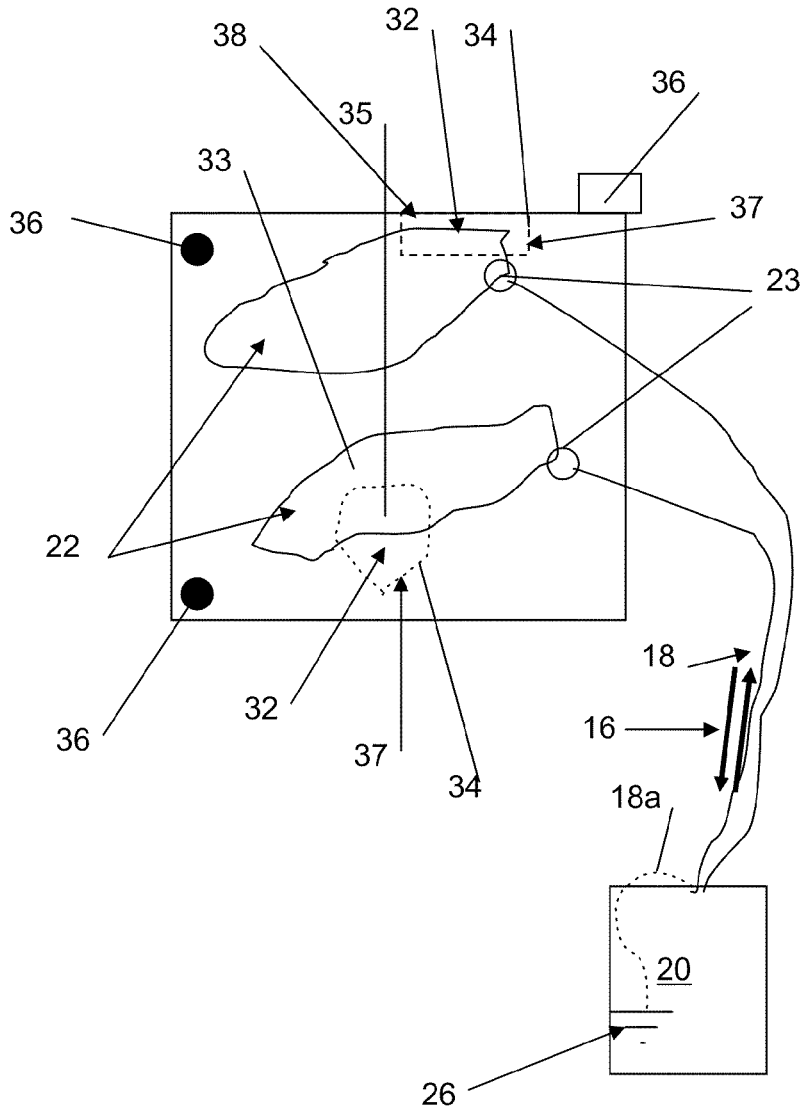

An example of the grounding structure 22*b* is a ground plane 22*b* (e.g. as a metal layer bonded to the carrier 24—the underside—in opposite to the antenna element 22*a*) connected to a ground 26 and/or the ground 26 itself (i.e. one of the conductors of the transmission line 18 is connected to the ground 26 itself shown by ghosted line 18*a* as an example embodiment of FIG. 3). It is recognised that the ground 26 is a metallic structure that may not be part of the PCB antenna 10 itself, rather is a metal structure associated with the current source/sink 20 (e.g. an electrical ground of a handheld terminal that is coupled to the PCB antenna 10 via the transmission line 18). It is recognised that the dimensional size and/or shape of the ground element 22*a* can influence the gain, resonant frequency/frequency band, and/or the impedance of the PCB antenna 10.

An antenna grounding structure 22*b* can be referred to as a structure for establishing a reference potential level for operating the active antenna element 22*a*. The antenna grounding structure 22*b* can be any structure closely associated with (or acting as) the ground 26 which is connected to the terminal 23 of the signal receiver or source opposing the active antenna terminal 23.

The ground element 22*b* can be formed on the carrier body 24 as conductive (e.g. metallic) pathways, patches, tracks, and/or trace patterns, for example etched from copper sheets laminated onto a non-conductive substrate (e.g. carrier body 24).

In telecommunication, a ground plane structure 22*b* or relationship exists between the antenna 22*a* and another object, where the only structure of the object is a structure which permits the antenna 22*a* to function as such (e.g., forms a reflector or director for an antenna). This sometimes serves as the near-field reflection point for an antenna 10, or as a reference ground in a circuit. A ground plane 22*b* can also be a specially designed artificial surface (such as the radial elements of a quarter-wave ground plane antenna 10). Artificial (or substitute) grounds (e.g., ground planes 22*b*) concerns the grounding structure for the antenna 10 and includes the conductive structure used in place of the earth and which grounding structure is distinct from the earth. For example, a ground plane 22*b* in the antenna 10 assembly is a layer 22*b* of copper that appears to most signals 12 as an infinite ground potential. The use of the ground plane 22*b* can help reduce noise and help provide that all integrated circuits within a system (e.g. handheld 20) compare different signals' voltages to the same potential. The ground plane 22*b* can also serve to make the circuit design of the antenna 10 more straightforward, allowing for the ground without having to run multiple tracks; such that any component (of the antenna 10 and/or the handheld 20) needing grounding is routed directly to the ground plane 22*b*. It is recognised that the grounding element 22*b* can be located on the carrier 24 as a metallic trace adjacent to and on the same side of the carrier 24 as the antenna element 22*a*, adjacent to (e.g. non overlapping) but on the opposite side of the carrier 24 as the antenna element 22*a*, and/or overlapping with and on the opposite side of the carrier 24 as the antenna element 22*a*.

It is also recognised that the ground plane 22*b* can sometimes be split and then connected by a thin trace. The thin trace can have low enough impedance to keep the connected sides (portions) of the ground plane 22*b* very close to the same potential while keeping the ground currents of one side/portion from significantly impacting the other, as provided by one or more respective transmission lines 18.

Transmission Line/Cable 18

As shown in FIGS. 1, 3, the transmission (e.g. feed) line 18 in a radio transmission, reception or transceiver system is the physical cabling 18 that carries the RF signal 16 to and/or from the antenna 10. The feed line 18 carries the RF energy for transmission and/or as received with respect to the PCB antenna 10. There are different types of feed lines 18 in use in modern wireless PCB antenna 10 systems, lines 18 such as but not limited to: the coaxial type, the twin-lead, and, at frequencies above 1 GHz, a waveguide. For example, the coaxial cable 18 is a rounded cable with a center conductor and a braided or solid metallic shield, usually copper or aluminum. The center conductor is separated from the outer shield by an insulator material, such that the center conductor is connected to the antenna element 22*a* and the braided/solid metallic shield is connected to the ground plane 22*b* and/or the ground 26, such that the antenna element 22*a* is separated electrically by the substrate 24.

The current flow in the elements 22*a,b* is along the direction of the feed line 18, so the magnetic vector potential and thus the electric field follow the current flow. The radiation 12 can be regarded as being produced by the "radiating slots" at top and bottom, or equivalently as a result of the current flowing on the patch 22*a* and the ground plane 22*b* (or equivalent ground structure 22*b*).

PCB Carrier/Substrate 24

Referring again to FIG. 2, the printed circuit board, or PCB, non-conductive carrier 24 is used to mechanically support conductive pathways, patches, tracks, and/or traces, (e.g. etched from copper sheets) laminated onto the non-conductive substrate 24. In the case of the antenna 10, the traces can be the antenna elements 22*a* and/or the ground element 22*b*, as desired.

As noted above, the conducting layers 22*a,b* of the antenna 10 can be made of thin copper foil. The carrier 24 is composed of an insulating layer dielectric typically laminated together with epoxy resin. There are a number of different dielectric materials that can be chosen to provide different insulating values for the carrier 24 depending on the requirements of the antenna elements 22*a,b*. Some of these dielectric materials are, for example, polytetrafluoroethylene (Teflon), FR-1, FR-2 (Phenolic cotton paper), FR-3 (Cotton paper and epoxy), FR-4 (Woven glass and epoxy), FR-5 (Woven glass and epoxy), FR-6 (Matte glass and polyester), G-10 (Woven glass and epoxy), CEM-1 (Cotton paper and epoxy), CEM-2 (Cotton paper and epoxy), CEM-3 (Woven glass and epoxy), CEM-4 (Woven glass and epoxy), CEM-5 (Woven glass and polyester).

Mounting Regions 36

The carrier 24 can be formed in a particular shape (e.g. in a rectangular form) on which the antenna element 22*a* trace is positioned thereon (e.g. laminated on one side surface thereof). Also included in the carrier 24 is one or more mounting regions 36 (e.g. protrusions) to facilitate mounting of the antenna 10 within the mobile terminal 20. A form of the carrier 24 is not limited to the rectangular form, as the carrier 24 can have various forms according to forms accommodated by the space available within the mobile terminal 20. It is recognised that the mounting regions 36 are dimensionally configured to match corresponding mounting locations 38 in the housing 100 of the mobile terminal 20, see FIG. 4. For example, the mounting regions 36 of the carrier 24 can be provided as a series of holes using a hole layout that matches the layout of threaded fasteners (i.e. mounting locations 38) provided by the housing 100 of the mobile device 20.

Referring to FIG. 3, shown are different embodiments of mounting regions 36, including protrusions of the carrier 24 itself as well as holes (shown as black circles) in the carrier 24 itself. In this example, it is noted that the predefined removal region 32 is located away from the mounting regions 36, in order to provide for consistent mounting of the antenna 10 in the housing 100 (see FIG. 4) of the device 20, after removal of the predefined removal region 32 for antenna 10 tuning purposes. This can provide for the installation of differently tuned antennas 10 in the same style housing 100 (i.e. the available mounting locations 38 of the housing 100 can be used for the antenna 10 even where at least some of the predefined removal regions 32 have been removed from the body of the carrier 24.

Predefined Removal Regions 32

Referring again to FIG. 2, the predefined removal regions 32 of the carrier 24 can be used to remove one or more corresponding removal element portions 33 of the antenna element 22*a* and/or the ground element 22*b* that are positioned within the predefined removal regions 32. These removal element portions 33 are differentiated from the remainder element portion(s) 35 which are positioned outside of the predefined removal regions 32 of the carrier 24. Thus, in effect, the remainder portions 35 are those elements 22 that contribute to the generation/reception of the waves 12 during operation of the antenna 10.

It is also recognised in the case of multiple predefined removal regions 32 that those predefined removal regions 32 not removed after tuning of the PCB antenna 10 are considered to contain remainder element portions 35 as well (i.e. those antenna element portions 35 that are used to contribute to the operational elements 22 of the antenna 10, once tuned).

For example, it is recognised that removal of the predefined removal region 32 and associated removal element portion 33 from the main carrier 24 body can result in changing the antenna 10 from a first resonance frequency (or first frequency band) to a second resonance frequency (or first frequency band). In other words, the first resonance frequency/frequency band of the antenna 10 is obtained using both the element portions 33 (on the predefined removal region 32) and the element portion 35 (outside of the predefined removal region 32). If the second resonance frequency/frequency band of the antenna 10 is desired, then the element portion 33 on the predefined removal region 32 is removed from the carrier 24 and the remaining element portion 35 outside of the predefined removal region 32 provides for operation of the antenna 10 in the second resonance frequency/frequency band. This use of the predefined removal region 32 could be used to provide a single antenna 10 component that would be selected to either one resonance frequency/frequency band or another depending upon the presence or removal of the predefined removal region 32 (and their associated removal element portions 35).

In a different embodiment, the carrier 24 material can be configured for a particular resonance frequency/frequency band and a plurality of the predefined removal regions 32 (and their associated removal element portions 33) can be used to fine tune (e.g. tune) the antenna 10 for operation in a particular device 20 environment. For example, the removal of one or more of the predefined removal regions 32 (and their associated removal element portions 33) could be done to shift the resonant frequency value and/or input impedance value of the antenna 10 incrementally towards the desired value(s). For example, if the resonance frequency of the antenna 10 is slightly too low, one or more predefined removal regions 32 (and their associated removal element portions 33) could be removed successively so as to make the antenna element 22*a* appropriately shorter. This could be the case where the antenna element 22*a* is made intentionally longer than necessary for the particular device 20 and desired resonance frequency/frequency band, so as to provide for removal of one or more of the predefined removal regions 32 (and their associated removal element portions 33) to shift the intentionally too low resonance frequency/frequency band towards the desired resonance frequency/frequency band, by shortening of the antenna element 22*a* (i.e. the remaining element 35) through removal of one or more of the predefined removal regions 32 (and their associated removal element portions 33).

Another embodiment is where even if the antenna 10 resonates at the appropriate frequency/band, the antenna 10 may not be well matched to the correct impedance pertaining to the particular device 20 configuration. Dependent on the antenna 10 type, there can be one or more possibilities to obtain appropriate impedance at the correct frequency through removal of the one or more of the predefined removal regions 32 (and their associated removal element portions 33), through factors such as but not limited to: size (e.g. length, shape, and/or width) of the ground plane/element 22*b*; distance from antenna element 22*a* to the ground plane/element 22*b*; dimensions (e.g. length, shape and/or width) of the antenna elements 22*b*, and/or feed point 23 location. Thus by varying these factors through removal of the one or more of the predefined removal regions 32 (and their associated removal element portions 33), the installer can improve the impedance match of the antenna 10 with the configuration of the respective device 20.

In a further embodiment, the removal of the one or more of the predefined removal regions 32 (and their associated removal element portions 33) can be used to both change the first resonance frequency (or first frequency band) to the second resonance frequency (or first frequency band) and to fine tune the resultant second resonance frequency (or first frequency band) and/or the impedance for optimized operation in a particular device 20 configuration.

Weakness Pattern 34

Referring to FIGS. 2, 3 shown is the carrier 24 having a number of predefined removal regions 32. Each of the regions 32 is defined using a weakness pattern 34 introduced in the carrier 24 material, in order to predispose the carrier 24 material to break along the weakness patterns 34 when force is applied (e.g. by an installer of the antenna 10 in a selected device 20) to the selected removal region 32. Upon breakage of the carrier 24 material along the weakness pattern 34, the respective removal region 32 can be separated from the remaining carrier 24, including any antenna element 22*a* and/or ground element 22*b* positioned on the removal region 32 of the carrier 24.

Examples of the weakness patterns 34 formed in the carrier 24 material 24 can be mechanical deformations in the carrier 24 material such as but not limited to: scoring of one or more lines (straight or otherwise, including segmented/broken line scoring) as a cut groove (or series of groove segments) in the rigid carrier 24 material, such that the groove(s) is/are used to predispose the carrier 24 material to break along the line(s) as a result of applied force on either side of the scored line(s); and/or a series of small holes or perforations created in a line (e.g. perforation line(s)) to provide for separation of two sections, such as allowing the carrier 24 material to be predisposed for breaking along the perforated line as a result of applied force on either side of the perforated line(s).

It is also recognised that the score line can be referred to as a split (weakness pattern 34) in the surface of the carrier 24 material. It is also recognised that the weakness pattern 34 can include slots cut through the thickness of the carrier 24 (e.g. extending from the top surface to the bottom surface of the carrier 24) to provide for removal of the removal regions 32 located away from a free edge 23 of the carrier 24 (such as the regions 32 associated with the elements 22*a,b* of FIG. 2) and therefore in the interior 25 of the carrier 24.

It is noted in FIG. 3 that a periphery 37 of the predefined removal portions 32 can be defined solely by the formed weakness pattern 34 or as a combination of the formed weakness pattern 34 and a free edge 38 of the carrier body 24.

Example Weakness Patterns 34

It is recognised that the antenna element 22*a* can be provided in different configurations as a trace on the surface of the carrier 24, using trace shapes such as but not limited to: dipole; bent dipole; folded dipole; meander dipole pattern; tilted whip; F-antenna; spiral; loop (e.g. half-wave, full-wave, series loaded short loop); patch; and/or slot.

Figure 5A:
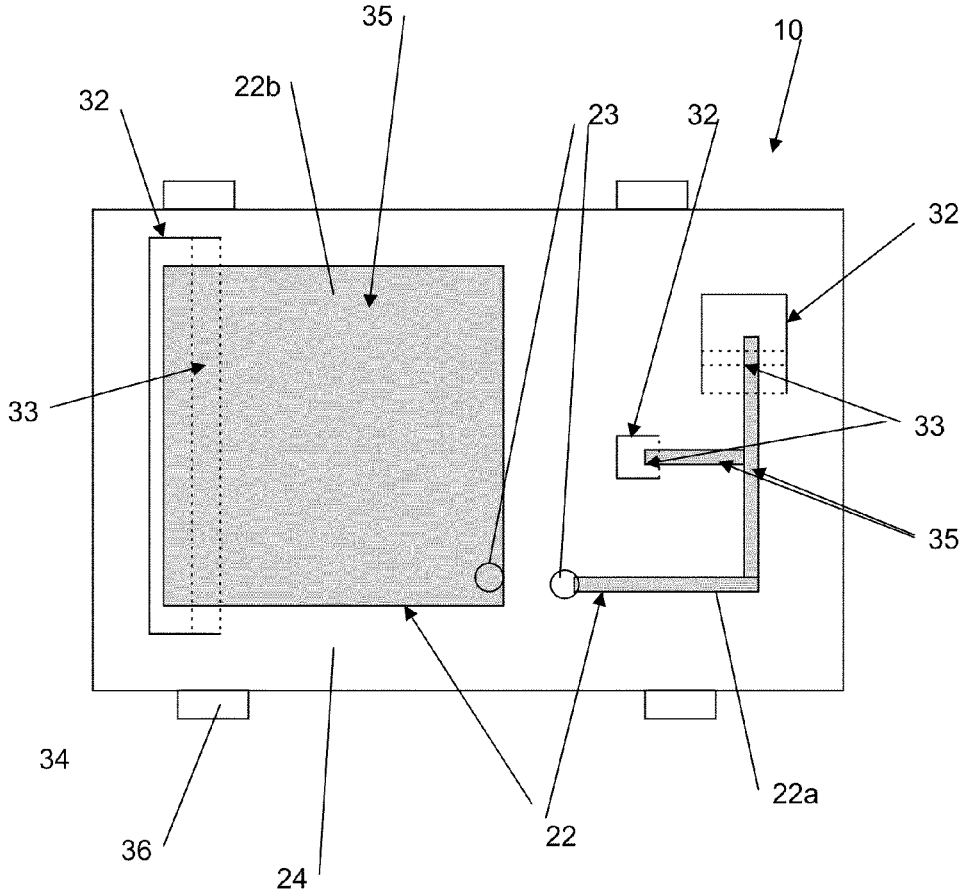
FIG. 5*a* is an embodiment of the predefined removal regions prior to removal for an F type antenna of the antenna of FIG. 1.
Figure 5B:
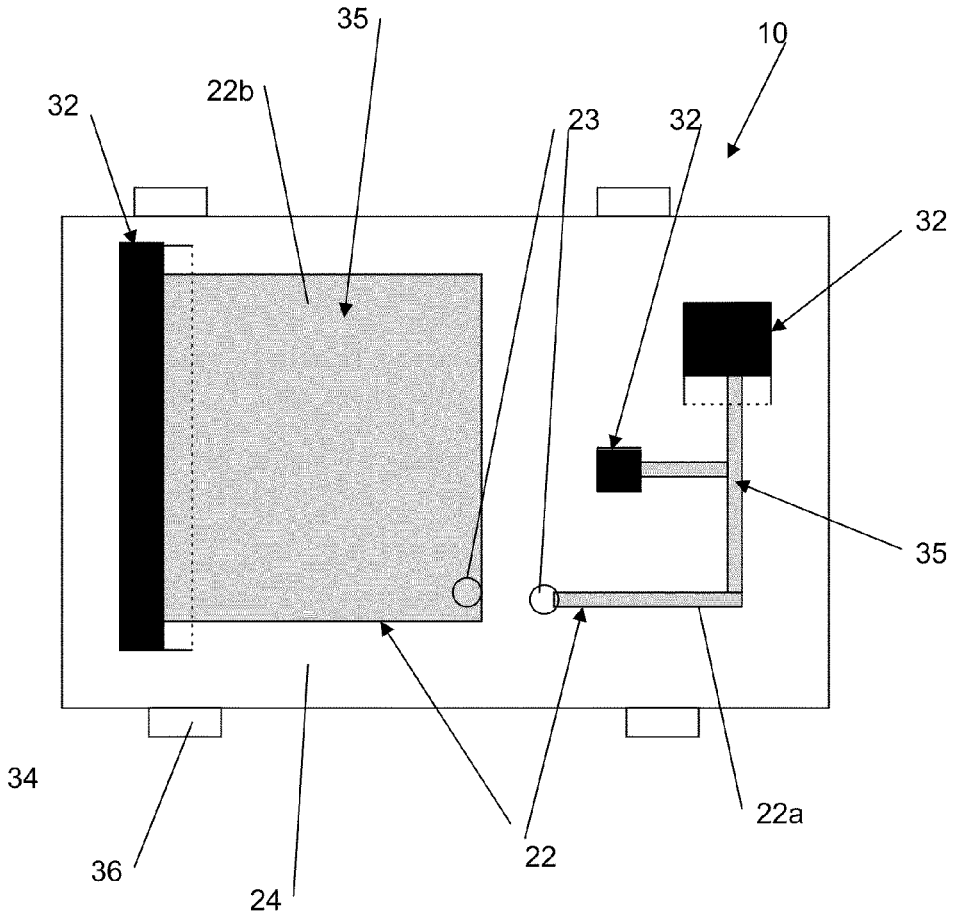
FIG. 5*b* shows the predefined removal regions after removal for the antenna of FIG. 5*a;*
Figure 5C:
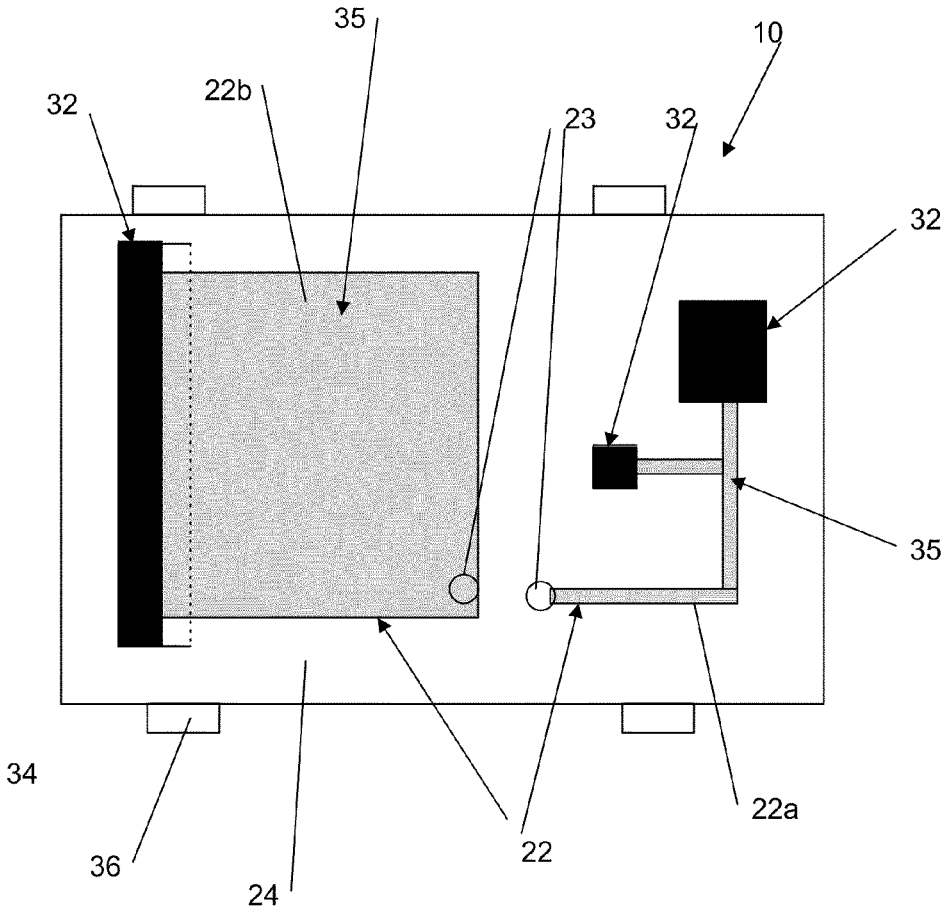
FIG. 5*c* is a further embodiment of the predefined removal regions of FIG. 5*b;*

FIGS. 5*a,b* show an example of potential tuning of a F antenna 10 through removal of some predefined removal regions 32 (and their associated removal element portions 33), show as solid black regions 32 in FIG. 5*b*. Accordingly, the removal of the carrier 24 material through breaking along the weakness pattern 34 (see FIG. 2) provided for removal of the selected removal element portions 33 positioned on the removed removal regions 32. In effect, the difference between the antenna element of FIG. 5*a* and FIG. 5*b* is that the portions of whip and leg of the antenna element 22*a* have been effectively shortened. Further, the area of the ground element 22*b* has also decreased. In FIG. 5*c*, addition removal portions 32 were removed from the whip portion of the antenna element 22*a* to provide for further tuning of the antenna 10.

Figure 6A:
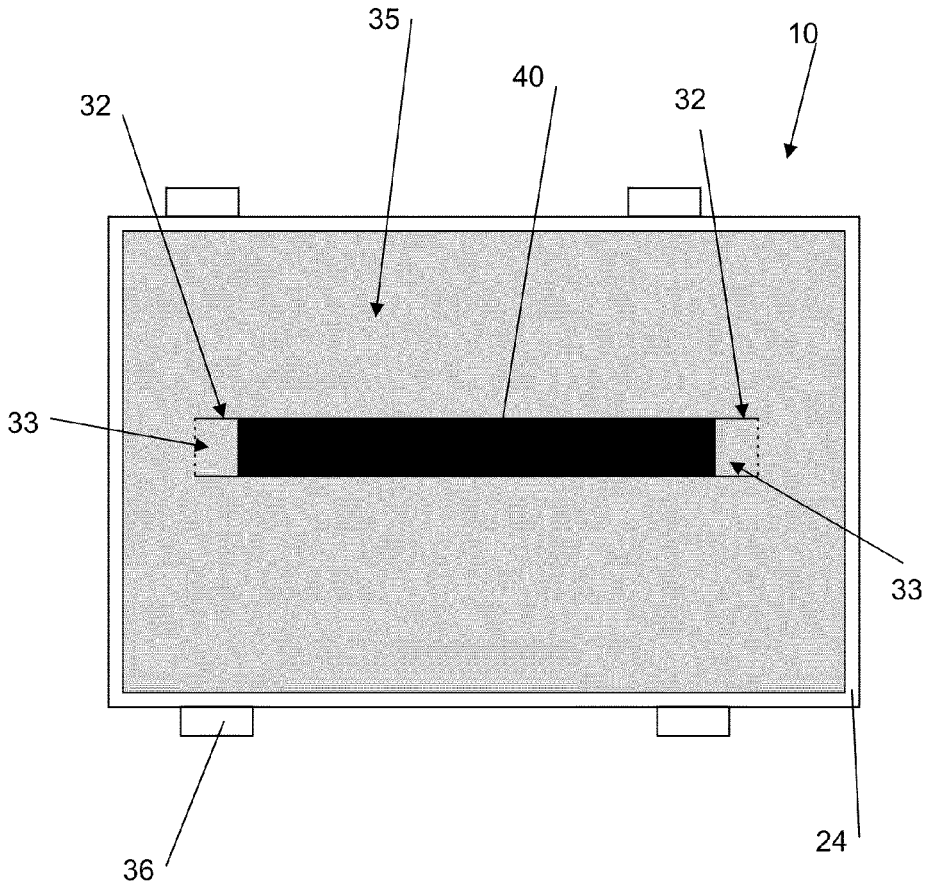
FIG. 6*a* is an embodiment of the predefined removal regions prior to removal for a slot type antenna of the antenna of FIG. 1.
Figure 6B:
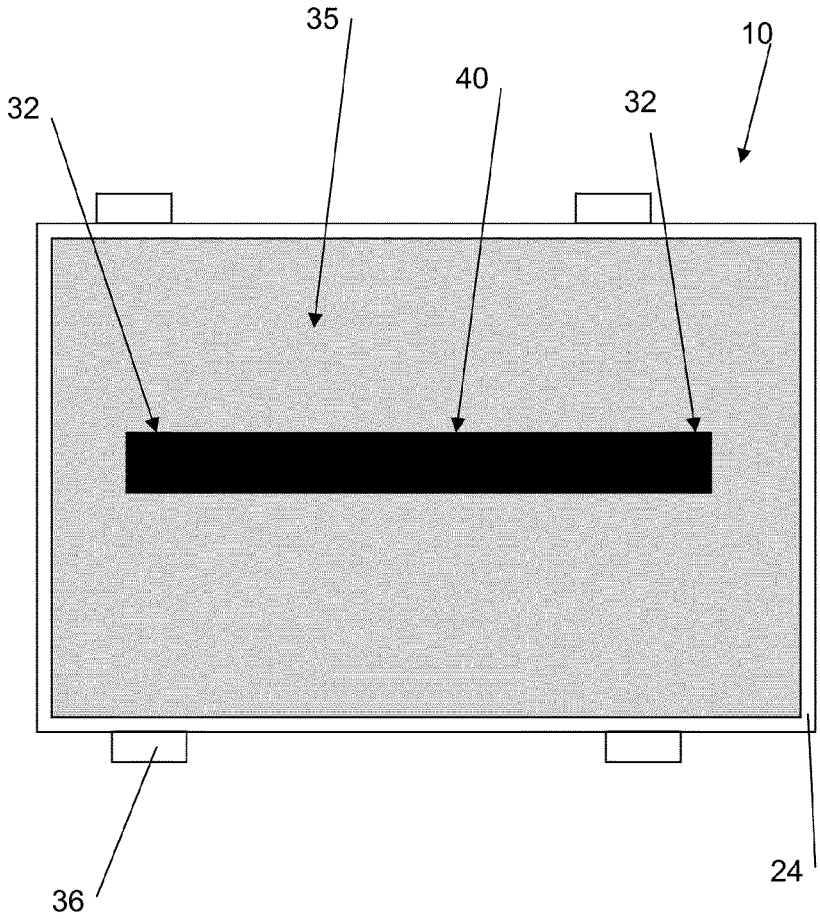
FIG. 6*b* shows the predefined removal regions after removal for the antenna of FIG. 6*a;*
Figure 6C:
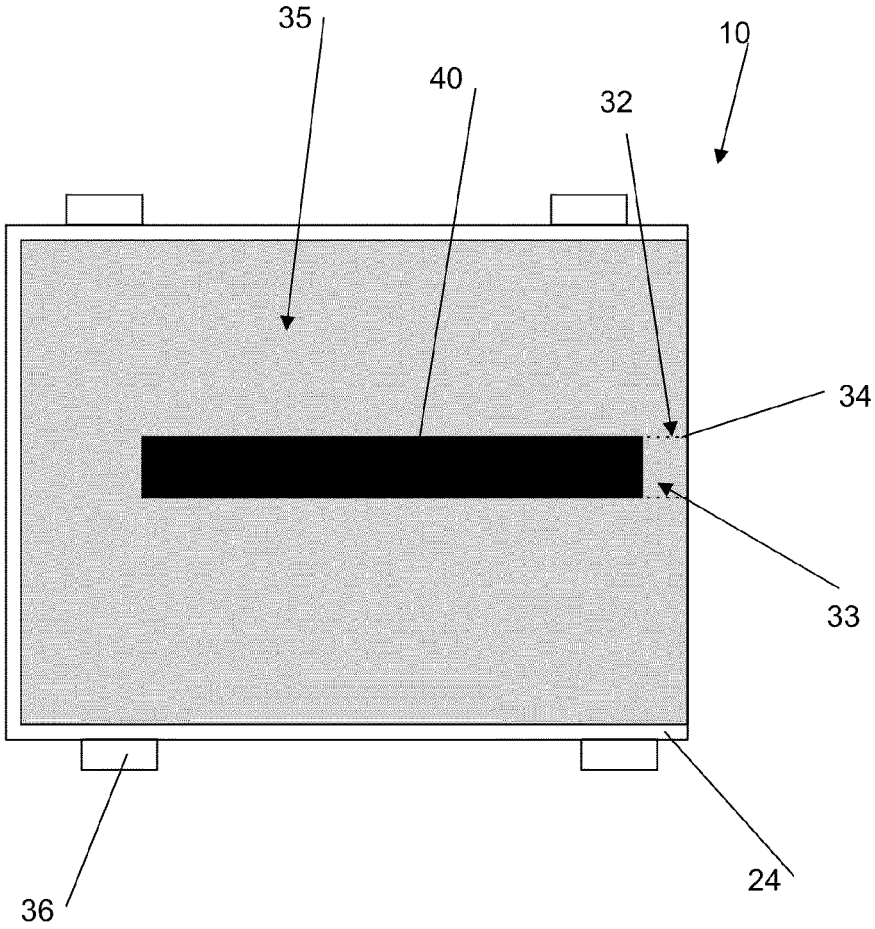
FIG. 6*c* is an alternative embodiment of the slot type antenna of FIG. 6*a;*

FIGS. 6*a,b* show an example of potential tuning of a half wave slot antenna 10 (slot 40) through removal of predefined removal regions 32 (and their associated removal element portions 33). Accordingly, the removal of the carrier 24 material through breaking along the weakness pattern 34 (see FIG. 2) provided for removal of the selected removal element portions 33 positioned on the removed removal regions 32. In effect, the difference between the antenna element of FIG. 6*a* and FIG. 6*b* is that end portions of the slot 40 have been removed so as to effectively lengthen the slot 40. FIG. 6*c* shows the weakness pattern 34 extending to an edge 42 of the carrier body 24, such that the predefined removal portion 32 is not wholly contained in the interior of the carrier body 24.

Figure 7A:
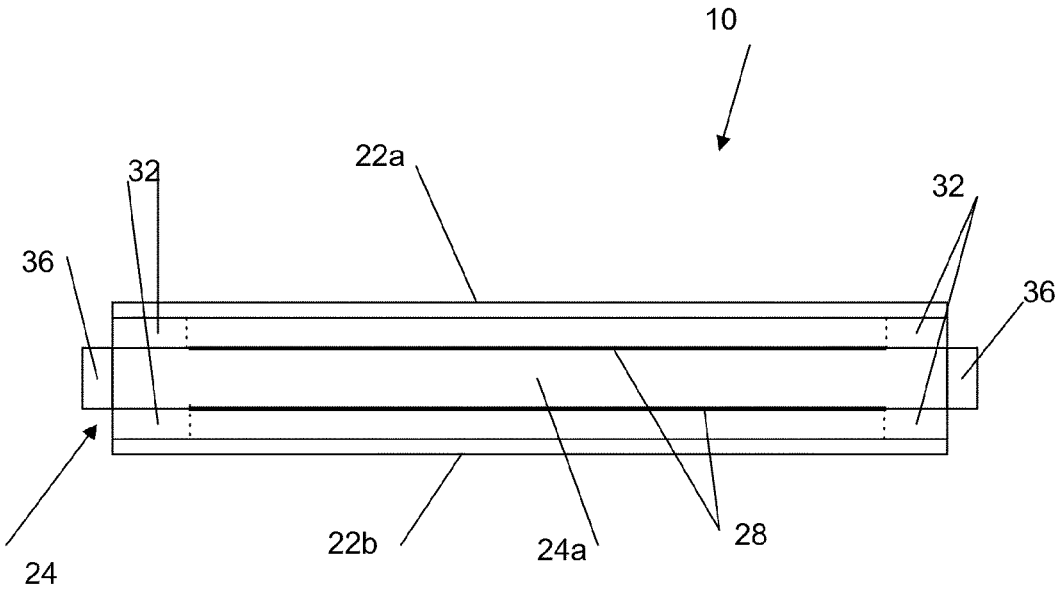
FIG. 7*a* shows a cross sectional view of an embodiment of the predefined removal regions prior to removal for a patch type antenna of the antenna of FIG. 1.
Figure 7B:
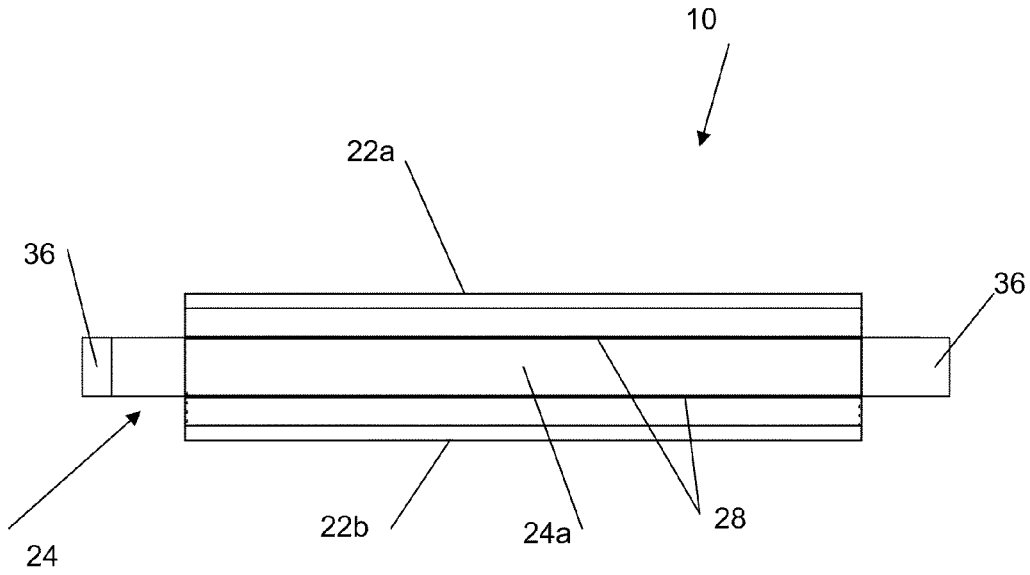
FIG. 7*b* shows the predefined removal regions after removal for the antenna of FIG. 7*a;*

FIGS. 7*a,b* show an example of potential tuning of a patch antenna 10 through removal of predefined removal regions 32 (and their associated removal element portions 33). A patch antenna 10 (also known as a Rectangular Microstrip Antenna) is named as attributed to the fact that it consists of the metal patch 22*a* suspended over a ground plane 22*b*, where provided. The patch antenna 10 is generally constructed on the dielectric carrier 24, for example employing the same sort of lithographic patterning used to fabricate printed circuit boards. The simplest patch antenna 10 uses a patch 22*a* which is one half-wavelength-long with the dielectric loading included over a larger ground plane 22*b* separated by a constant thickness dielectric carrier 24. The carrier 24 is composed of a number of layers (e.g. three) that are partially bonded together in a sandwich configuration using lamination (e.g. adhesive) layers 28. In this case, by example, the lamination layers 28 are configured so as to provide for removal of the removal regions 32 without affecting positioning of the mounting regions 36 (i.e. the removal regions 32 are not bonded to an inner layer 24*a* of the carrier 24). Accordingly, the removal of the carrier 24 material through breaking along the weakness pattern 34 (see FIG. 2) provided for removal of the selected removal element portions 33 positioned on the removed removal regions 32. In effect, the difference between the elements 22*a,b* of FIG. 7*a* and FIG. 7*b* is that the area of the antenna element 22*a* have been effectively decreased. Further, the area of the ground element 22*b* has also been decreased. It is recognised that only the antenna element 22*a* could be decreased, if desired.

Figure 8A:
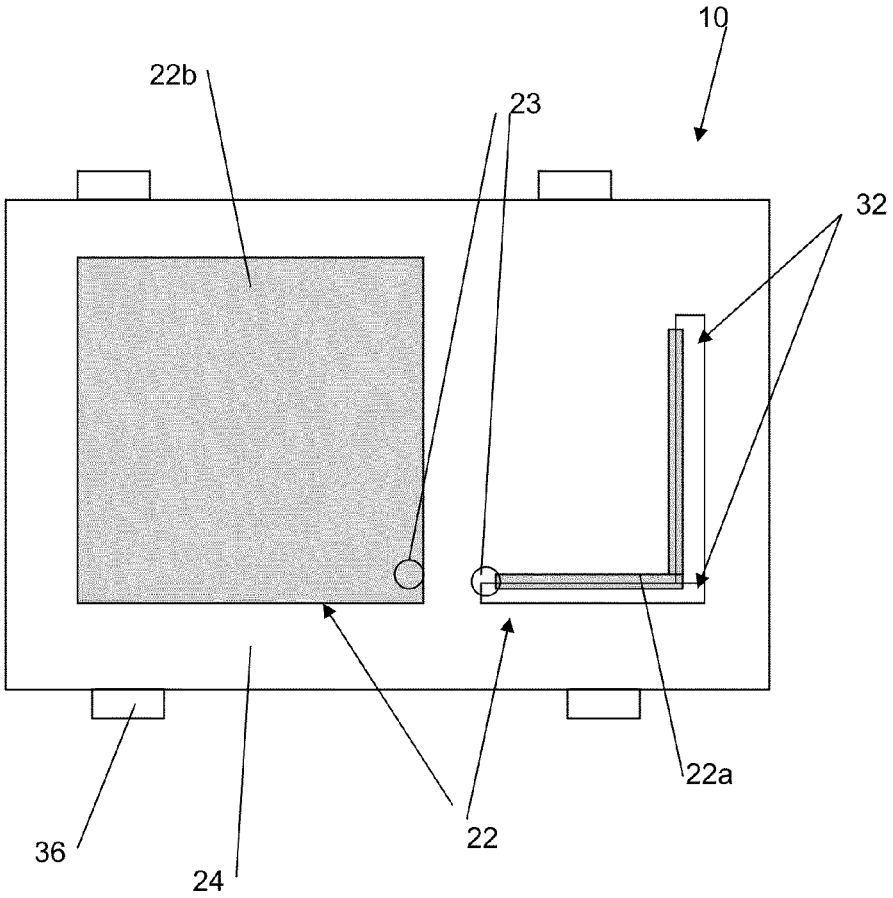
FIG. 8*a* is a further embodiment of the predefined removal regions prior to removal for an F type antenna of the antenna of FIG. 1.
Figure 8B:
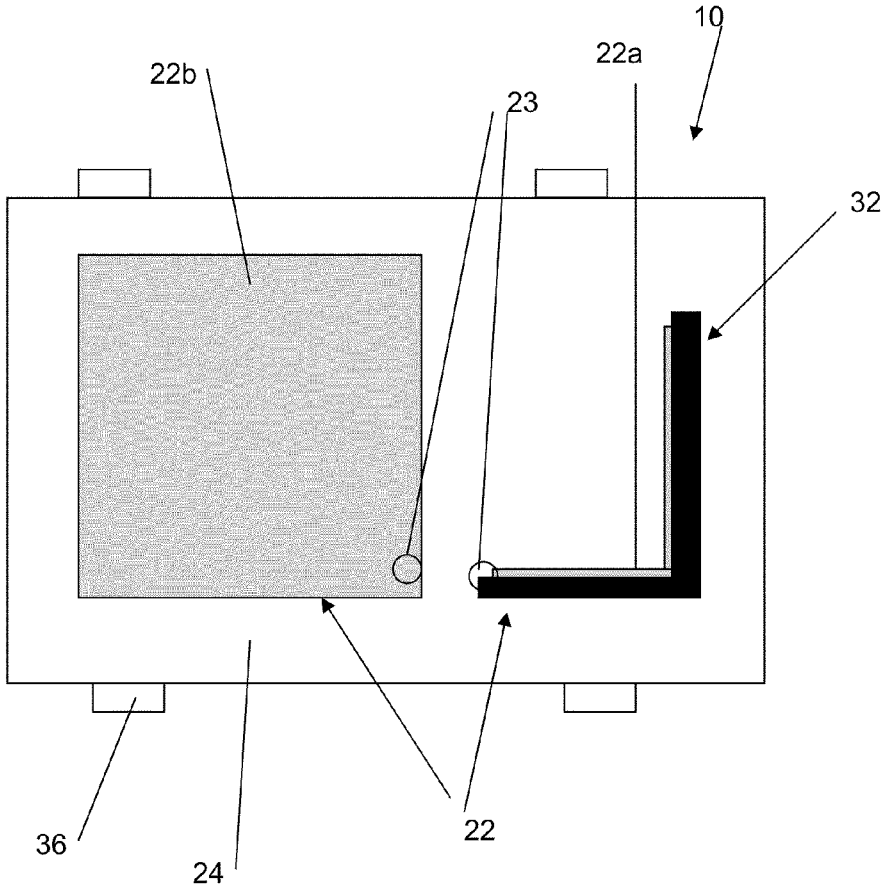
FIG. 8*b* shows the predefined removal regions after removal for the antenna of FIG. 8*a;*

FIGS. 8*a,b* show an example of adjusting (i.e. decreasing) the width of the antenna element trace 22*a* of the antenna as compared to the length adjustments shown in FIGS. 5*a,b,c*.

It is recognised in the above examples that the removal regions 32 can be used to remove a portion of the antenna element 22*a* and/or a portion of the ground element 22*b* positioned on the carrier 24. It is also recognised in the above examples for weakness patterns 34, the positioning of the removal regions 32 in the carrier 24 can be done so as to not affect the structural integrity and/or positioning of the mounting regions 36. This positioning of the removal regions 32 away from the mounting regions 36 provides for consistent mounting of the antenna 10 in the corresponding device 20, with or without the presence of the removal regions 32 in the carrier 24.

Manufacture of the Antenna 10

In view of the above, referring to FIGS. 1 and 3, the antenna 10 is configured for at least one of transmission or reception of electromagnetic waves 12 with respect to a surrounding environment 14. The antenna 10 has the antenna element 22*a* positioned in metal trace on the carrier body 24, such that the antenna element 22*a* is isolated from the electrical ground 26 (e.g. ground element 22*b*) of the antenna 10. The antenna 10 comprises at least one predefined removal portion 32 positioned in the carrier body 24 and containing a removal fraction 33 of the antenna element 22*a*, such that the carrier body 24 located outside of the predefined removal portion 32 contains the remainder fraction 35 of the antenna element 22*a*. A weakness pattern 34 in the carrier body 24 about at least part of the periphery of the at least one predefined removal portion 32 is used to configure the predefined removal portion 32 as predisposed to separate from the carrier body by breaking along the weakness pattern upon application of force. Upon the act of separation of the predefined removal portion 32, the corresponding removal fraction (e.g. bonded to the carrier body in the predefined removal portion 32) is also separated from the antenna element 22*a* leaving the remainder fraction. In this manner, separation of the predefined removal portion 32 and corresponding removal fraction 33 provides for modification of at least one tuning parameter of the antenna 10 having the remainder fraction 35 as the tuned antenna element 22*a*.

In view of the above, referring to FIGS. 1 and 3, the antenna 10 is configured for at least one of transmission or reception of electromagnetic waves 12 with respect to a surrounding environment 14. The antenna 10 has the ground element 22*b* positioned in metal trace on the carrier body 24, such that the ground element 22*b* is isolated from the antenna element 22*a* of the antenna 10. The antenna 10 comprises at least one predefined removal portion 32 positioned in the carrier body 24 and containing a removal fraction 33 of the ground element 22*b*, such that the carrier body 24 located outside of the predefined removal portion 32 contains the remainder fraction 35 of the ground element 22*b*. A weakness pattern 34 in the carrier body 24 about at least part of the periphery of the at least one predefined removal portion 32 is used to configure the predefined removal portion 32 as predisposed to separate from the carrier body 24 by breaking along the weakness pattern 34 upon application of force. Upon the act of separation of the predefined removal portion 32, the corresponding removal fraction 33 (e.g. bonded to the carrier body 24 in the predefined removal portion 32) is also separated from the ground element 22*b* leaving the remainder fraction 35. In this manner, separation of the predefined removal portion 32 and corresponding removal fraction 33 provides for modification of at least one tuning parameter of the antenna 10 having the remainder fraction 35 as the tuned ground element 22*b*.

In view of the above, it is also recognised that the predefined removal portions 32 and the corresponding removal fractions 33 and remainder fractions 35 can be part of the antenna element 22*a* in metal trace, the ground element 22*b* in metal trace, or a combination thereof.

Manufacturing Apparatus 50

Figure 9:
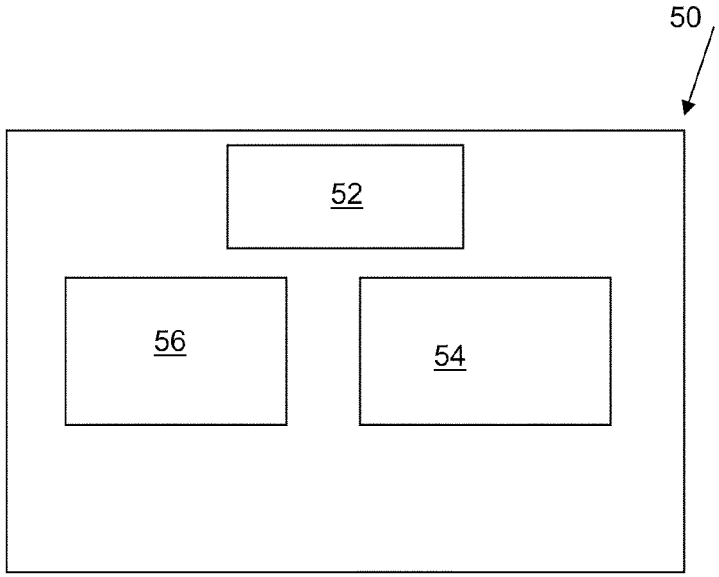
FIG. 9 shows an example manufacturing apparatus for the antenna of FIG. 3.

Referring to FIG. 9, shown is an example manufacturing apparatus 50 for manufacturing the antenna 10. The apparatus 50 includes one or more carrier 24 holders 52 for use in supporting the carrier body 24 during formation of the weakness pattern 34 and/or the metal trace application, a pattern former 54 (e.g. a scorer, a cutter, a drill, a milling machine, etc.) for forming the weakness pattern 34 in the carrier body 24, and a metal trace applicator 56 for forming/applying the element(s) 22*a,b* on the carrier body 24 (including both the removal 33 and remainder 35 fractions).

The metal trace applicator 56 can take the form of bonding a layer of copper over the entire substrate 24, sometimes on both sides, (creating a "blank PCB") then removing unwanted copper after applying a temporary mask (e.g. by etching), leaving only the desired copper traces of the antenna element 22*a* and/or ground element 22*b*. The metal trace applicator 56 can also operate by adding traces to the bare substrate 24 (or a substrate 24 with a very thin layer of copper) usually by a complex process of multiple electroplating steps. Common "subtractive" methods (methods that remove copper) used for the production of printed circuit boards are: silk screen printing uses etch-resistant inks; photoengraving using a photomask and chemical etching to remove the copper foil from the substrate 24; and PCB milling using a two or three-axis mechanical milling system to mill away the copper foil from the substrate 24.

Manufacturing Methods 200,300

Figure 10:
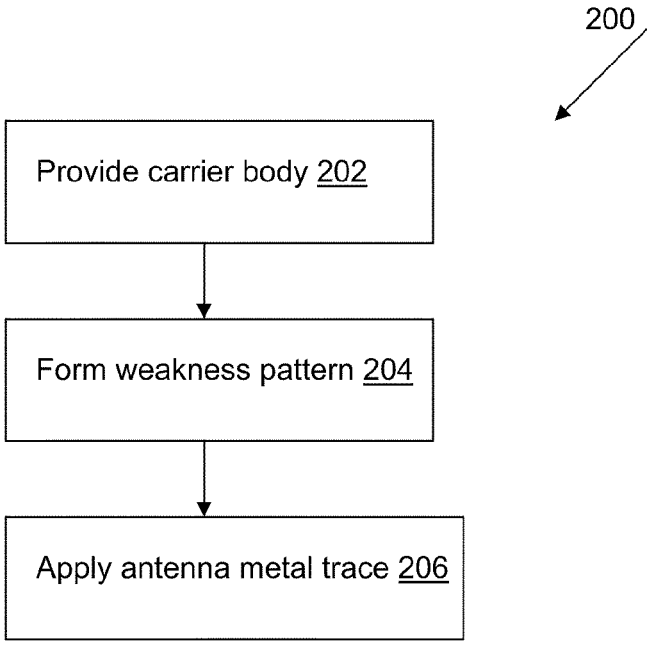
FIG. 10 shows an example manufacturing method for the antenna element of the antenna of FIG. 3.

Referring to FIG. 10, an example method is shown for manufacture 200 of the antenna 10 configured for at least one of transmission or reception of electromagnetic waves 12 with respect to a surrounding environment 14, the antenna 10 having the antenna element 22*a* positioned in metal trace on the carrier body 24, antenna element 22*a* being isolated from the electrical ground 22*b*,26 of the antenna 10. At step 202 the carrier body is provided; at step 204 a weakness pattern is formed in the carrier body about at least part of the periphery 37 of at least one predefined removal portion 32, the weakness pattern 34 configured for predisposing the carrier body 24 to break along the weakness pattern 34 upon application of force, the at least one predefined removal portion 32 positioned in the carrier body 24 for containing the removal fraction 33 of the antenna element 22*a*, such that the carrier body 24 located outside of the predefined removal portion 32 is configured for containing the remainder fraction 35 of the antenna element 22*a*. At step 206 the metal trace of the antenna element 22*a* is applied on the carrier body 24 to form the removal fraction 33 and the remainder fraction 35. It is recognised that the manufacture ordering of the steps 204 and 206 can be other than as provided (e.g. first application of metal trace and then forming of the weakness pattern 34). In use of the manufactured antenna 10, application of the force by an installer and subsequent separation of the predefined removal portion 32 and corresponding removal fraction 33 from the carrier body 24 provides for modification of at least one tuning parameter of the antenna 10 having the resulting remainder fraction 35 as the tuned antenna element 22*a*.

Figure 11:
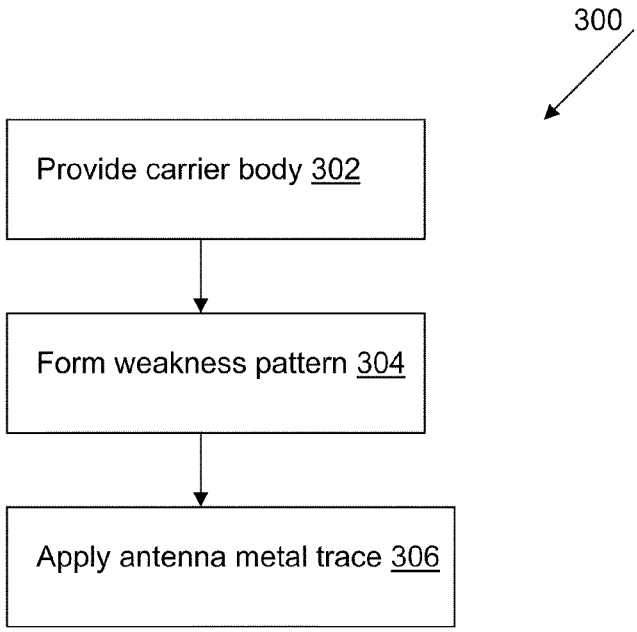
FIG. 11 shows an example manufacturing method for the ground element of the antenna of FIG. 3.

Referring to FIG. 11, an example method is shown for manufacture 300 of the antenna 10 configured for at least one of transmission or reception of electromagnetic waves 12 with respect to a surrounding environment 14, the antenna 10 having the ground element 22*b* positioned in metal trace on the carrier body 24, the ground element 22*b* being isolated from the antenna element 22*a* of the antenna 10. At step 302 the carrier body 24 is provided; at step 304 a weakness pattern 34 is formed in the carrier body 24 about at least part of the periphery 37 of at least one predefined removal portion 32, the weakness pattern 34 configured for predisposing the carrier body 24 to break along the weakness pattern 34 upon application of force, the at least one predefined removal portion 32 positioned in the carrier body 24 for containing the removal fraction 33 of the ground element 22*b*, such that the carrier body 24 located outside of the predefined removal portion 32 is configured for containing the remainder fraction 35 of the ground element 22*b*. At step 306 the metal trace of the ground element 22*b* is applied on the carrier body 24 to form the removal fraction 33 and the remainder fraction 35. It is recognised that the manufacture ordering of the steps 304 and 306 can be other than as provided (e.g. first application of metal trace and then forming of the weakness pattern 34). In use of the manufactured antenna 10, application of the force by an installer and subsequent separation of the predefined removal portion 32 and corresponding removal fraction 33 from the carrier body 24 provides for modification of at least one tuning parameter of the antenna 10 having the resulting remainder fraction 35 as the tuned ground element 22*b*.

In view of the above, it is also recognised that both/either of the manufacture operations 200,300 can be used for formation of the predefined removal portions 32, and that the corresponding removal fractions 33 and remainder fractions 35 can be part of the antenna element 22*a* in metal trace, the ground element 22*b* in metal trace, or a combination thereof.

The above relates to antenna tuning based on removable portions 33 of the antenna PCB board 24, which can be internal to the board or are otherwise positioned to help retain consistent mounting locations 36 for the board 24 to the housing 100 of the handheld 20, once the removable portion(s) 33 has/have been removed. Therefore, for example, there would be an antenna PCB 24 having one or more removable portions 33 to allow for the remaining PCB 24 with fractions 35 to be tuned for a different antenna 10, as compared to the antenna 10 tuned to the unmodified PCB 24 (having both fractions 33 and 35). Advantages for the use of weakness patterns 34 and corresponding defined fractions 33,35 include, for example, variable tuning for the antenna 10 based on environment (e.g. housing configuration, other electrical components in the housing 100, etc.) and/or resonant frequency band consideration of the device 20, mounting of the board 24 in the housing 100 may not be affected by portion 33 removal, prescoring of the antenna PCB 24 to allow for internal breaking off of selected portions 32 of the board 24 for tuning purposes while allowing for consistent external profile of the board for board mounting considerations, and/or the ability to have one component antenna part that can be modified for tuning as different antennas. The relevant areas of technology for this can be any antenna tuning environment in which different antenna configurations are contemplated.

I claim:

1. An antenna configured for at least one of transmission or reception of electromagnetic waves with respect to a surrounding environment, the antenna having an antenna element positioned in metal trace on a carrier body, antenna element being isolated from an electrical ground of the antenna, the antenna comprising:

at least one predefined removal portion positioned in the carrier body for containing a removal fraction of the antenna element, such that the carrier body located outside of the predefined removal portion is configured to contain the remainder fraction of the antenna element; and a weakness pattern in the carrier body about at least part of the periphery of the at least one predefined removal portion, the weakness pattern configured for predisposing the carrier body to break along the weakness pattern upon application of force, such that the at least one predefined removal portion and corresponding removal fraction would be separated from the antenna upon application;

wherein the separation of the predefined removal portion and corresponding removal fraction modifying of at least one tuning parameter of the antenna having the remainder fraction as the tuned antenna element.

2. The antenna of claim 1 further comprising a plurality of the predefined removal portions such that each of the plurality of the predefined removal portions contains a corresponding removal fraction of the antenna element.

3. The antenna of claim 2, wherein at least one of the corresponding removal fractions becomes part of the remainder fraction of the tuned antenna element when the weakness pattern of the respective predefined removal portion remains unbroken.

4. The antenna of claim 2 further comprising one or more mounting regions formed on the carrier body for facilitating coupling of the carrier body with a housing or internal element of at least one of a mobile computing device, a mobile communication device, a cellular telephone device or a fixed communication device.

5. The antenna of claim 4 further comprising the plurality of the predefined removal portions located away from the one or more mounting regions, such that consistent coupling of the carrier body with the housing or internal element is provided where one or more of the plurality of the predefined removal portions are separated from the carrier body.

6. The antenna of claim 2, wherein the carrier body is composed of a resin impregnated dielectric material.

7. The antenna of claim 2, wherein the metal trace provides for an antenna type selected from the group consisting of: dipole; loop; and slot.

8. The antenna of claim 2, wherein the metal trace provides for a patch type antenna.

9. The antenna of claim 8 further comprising a ground element positioned in metal trace on the carrier body on an opposite side to that of the antenna element.

10. The antenna of claim 9 further comprising the carrier body composed of a plurality of layers coupled together to facilitate removal of the at least one predefined removal portion separate from the part of the carrier body having the ground element positioned thereon.

11. The antenna of claim 2, wherein the tuning parameter is selected from the group consisting of: resonant frequency of the antenna; impedance of the antenna; and feed point location.

12. The antenna of claim 11, wherein the removal of the at least one predefined removal portion changes a shape of the antenna element.

13. The antenna of claim 12, wherein the shape is selected from the group consisting of electrical length of the antenna element and electrical width of the antenna element.

14. The antenna of claim 11 further comprising a ground element positioned in metal trace on the carrier body and at least one of the plurality of the predefined removal portions is a ground removal fraction of the ground element, such that the carrier body located outside of the ground removal fraction contains the ground remainder fraction of the ground element.

15. The antenna of claim 14, wherein the removal of the at least one predefined removal portion changes a shape of the ground element.

16. The antenna of claim 15, wherein the shape is selected from the group consisting of electrical length of the ground element and electrical width of the ground element.

17. The antenna of claim 1, wherein the at least one predefined removal portion is configured to change operation of the antenna element from a first resonance frequency band to a second resonance frequency band, such that the center frequency of the second resonance frequency band is outside of the first resonance frequency band.

18. The antenna of claim 1, wherein the at least one predefined removal portion is configured to change operation of the antenna element from a first resonance frequency band to a second resonance frequency band, such that the center frequency of the second resonance frequency band is inside of the first resonance frequency band.

19. The antenna of claim 2, wherein the weakness pattern is selected from the group consisting of: one or more scoring lines; one or more sequential perforations; and one or more slots cut through the thickness of the carrier body.

20. A method for manufacturing an antenna configured for at least one of transmission or reception of electromagnetic waves with respect to a surrounding environment, the antenna having an antenna element positioned in metal trace on a carrier body, antenna element being isolated from an electrical ground of the antenna, the method comprising the steps of:

providing a carrier body;

forming a weakness pattern in the carrier body about at least part of the periphery of at least one predefined removal portion, the weakness pattern configured for predisposing the carrier body to break along the weakness pattern upon application of force, the at least one predefined removal portion positioned in the carrier body for containing a removal fraction of the antenna element, such that the carrier body located outside of the predefined removal portion is configured for containing the remainder fraction of the antenna element; and applying the metal trace of the antenna element on the carrier body to form the removal fraction and the remainder fraction;

wherein application of the force and subsequent separation of the predefined removal portion and corresponding removal fraction from the carrier body modifying of at least one tuning parameter of the antenna having the remainder fraction as the tuned antenna element.

* * * * *